United States Patent [19]

Ely et al.

[11] 4,053,707

[45] Oct. 11, 1977

[54] METHOD AND APPARATUS FOR HIGH VOLTAGE INSULATION

[75] Inventors: Cyril Harold Arthur Ely, Effingham; Peter John Lambeth, Bookham; John Sidney Thomas Looms, East Molesey, all of England

[73] Assignee: Central Electricity Generating Board, London, England

[21] Appl. No.: 671,295

[22] Filed: Mar. 29, 1976

[30] Foreign Application Priority Data

Apr. 7, 1975 United Kingdom ..... 14244/75

[51] Int. Cl.[2] ..... H01B 17/50; H01B 17/60; H01B 17/32

[52] U.S. Cl. ..... 174/209; 174/211; 174/212; 428/65; 428/542

[58] Field of Search ..... 174/139, 140 R, 141 R, 174/178, 179, 195, 209, 210, 211, 212; 29/631; 47/23, 24, 25, 32; 428/65, 542

[56] References Cited

U.S. PATENT DOCUMENTS

| | | | |
|---|---|---|---|
| 1,691,330 | 11/1928 | Austin | 174/139 |
| 1,967,654 | 7/1934 | Austin | 174/139 X |
| 3,618,260 | 11/1971 | Convey, Jr. et al. | 47/32 |
| 3,643,290 | 2/1972 | Milne | 174/83 UX |

FOREIGN PATENT DOCUMENTS

| | | | |
|---|---|---|---|
| 506,262 | 10/1954 | Canada | 174/139 |
| 588,841 | 2/1959 | Italy | 47/32 |

*Primary Examiner*—Laramie E. Askin
*Attorney, Agent, or Firm*—Lyon & Lyon

[57] ABSTRACT

An insulator having a central portion or stem and one or more sheds is provided with a barrier over at least one of the sheds whereby a substantial improvement in withstanding flashover is obtained yet significant damage to the surface of the insulator is avoided. The barrier comprises a sheet of dielectric material positioned over the upper surface of a shed but spaced away therefrom, the sheet extending radially outwardly to overhang the periphery of the shed. The barrier is furthermore spaced radially away from the central portion or stem of the insulator over at least a substantial part of the inner periphery of the barrier. The barrier may be made of rigid material, for example, constructed from a plurality of sectors but is preferably made from a flexible material so that it can be fitted around an existing conventional insulator. The underside of the barrier is preferably provided with a number of projections for spacing it away from the upper surface of the shed.

41 Claims, 19 Drawing Figures

METHOD AND APPARATUS FOR HIGH VOLTAGE INSULATION

BACKGROUND OF THE INVENTION

This invention relates to electrical insulators of the kind having a central portion with one or more sheds extending outwardly therefrom.

Insulators for high voltages in power supply systems commonly comprise a stem or a body of cylindrical or truncated conical form with sheds extending outwardly therefrom, the sheds being spaced along the length of the stem. Such insulators are most commonly made of porcelain although other materials may be used, for example epoxy resins. Particularly in use in the open air, pollution collects on such insulators leading to the occurrence of electrical discharges over the surface of the insulator. The present invention is directed to hindering the propagation of such electrical discharges and thereby increasing the ability of the insulators to avoid flashover.

It is well known to provide means for washing insulators particularly under conditions where they are exposed to possible heavy pollution, as for example near a sea coast where salt may be deposited on the insulators. Such washing is effected by means of high pressure water jets or sprays and will remove the pollution layer from the surface of the insulator. During such washing and just after washing when water with a high pollution content is running down the insulator, there is a high risk of flashover occurring and the present invention finds particular application for such insulators having washing facilities.

SUMMARY OF THE INVENTION

The present invention is based on our surprising observation that a substantial improvement in withstanding flashover can be obtained without significant surface damage to the insulator by the provision of a discharge barrier comprising a sheet of dielectric material which is positioned over the upper surface of at least one of the sheds but spaced away therefrom, the sheet extending radially outwardly to overhang the periphery of the shed by at least 5 mm around the whole of the shed, the barrier furthermore being spaced radially from the central portion or stem of the insulator over at least a substantial part of the inner periphery of the barrier. The spacing from the central portion or stem may typically be of the order of 2 to 20 mm.

According to the present invention, therefore, there is provided on an insulator having a central portion or stem and one or more sheds extending outwardly therefrom a discharge barrier comprising a sheet of dielectric material positioned around the central portion or stem of the insulator above at least one shed, said sheet being spaced away from the upper surface of the shed, preferably by means of projections on its under surface, said sheet furthermore being arranged to overhang the shed by extending radially outwardly therefrom for a distance of at least 5 mm and preferably by a distance of 20 mm or more, said barrier furthermore being dimensioned to leave a gap between the insulator central portion or stem and the sheet over at least a substantial part of the inner periphery of the barrier.

It will be appreciated that the term "sheet" is used herein in a broad sense and is not limited to planar shapes or to shapes not exceeding a certain thickness or to shapes of constant thickness.

DESCRIPTION OF PREFERRED EMBODIMENTS

The discharge barrier may be made of rigid material; in such a case it may be made of two or more sectors e.g. moulded sectors formed together. Such a construction may be convenient to conform to a dome-shaped insulator.

In general, however, the discharge barrier is made flexible, e.g. of flexible sheet material, to facilitate its fitting around an existing insulator of porcelain or glass or other conventional material. Such flexible discharge barriers are especially suitable for cone-shaped insulators.

The spacing of the discharge barrier from the surface of the shed is a compromise between conflicting requirements and may be determined empirically. The closer it is to the surface of the insulator shed, the more effective is the barrier in preventing the formation of an arc or in extinguishing any arc over that surface of the shed. If the barrier is too close to the surface of a porcelain insulator, a discharge between the barrier and the insulator surface may cause damage to the insulator surface. The spacing of the barrier from the shed however is kept as small as possible subject to avoiding burning in this way of the insulator surface. Typically the spacing is a few millimeters. In one embodiment of the invention 6 mm has been found suitable.

Using a discharge barrier which is spaced away from the shed surface and the stem surface as described above there is a substantial improvement in withstanding flashover yet significant damage to the surface of the insulator is avoided. Current can flow both over the upper surface of the discharge barrier and in parallel with it between the discharge barrier and the surface of the shed. The former path is longer than the latter and the proportion of the total current taking this path is likely to be significantly less than that flowing under the barrier. Both because of the reduction in current and the longer path the propagation of a discharge over the barrier will be inhibited as compared with the propagation of a discharge over an uncovered shed. Formation and propagation of an arc under the barrier is hindered by the high electric stress caused by the thermal losses from discharge, the presence of steam at high pressure as well as by the reduction in current. For these reasons therefore the discharge becomes unstable and then extinguishes.

Although outdoor insulators generally have many sheds, experiments show that the discharge barriers are so effective that there is no need to provide one for each shed. A single discharge barrier on an insulator gives a large measure of added protection against the risk of flashover. Additional barriers will give some measure of increased protection but, in very high voltage insulators, there is no need to provide discharge barriers on each of the sheds. Typically, in an insulator for operating on a 400,000 volt system, only between 5 and 10 discharge barriers might be provided on an insulator which typically may have between 22 and 33 porcelain sheds.

As mentioned above, although the efficacy of the barrier in extinguishing an arc is increased with the closeness of the spacing of the barrier to the surface of the shed, too close a spacing may result in burning the surface of the porcelain under the barrier. The optimum dimensions, which will typically be of the order of a few millimeters, may readily be determined empirically.

It is however desirable that the spacing of the barrier from the upper surface of the shed should as far as possible be uniform. It is convenient to control this spacing by providing a number of small projections of uniform depth on the under surface of the barrier sheet. These projections may typically be arranged on the sheet to be located uniformly around the axis of the insulator. Preferably adjacent projections are staggered to be at different radii from the centre of the insulator.

The upper surface of the barrier is preferably smooth. This prevents the build-up of pollution which may promote flashoever, and avoids discharges occurring repeatedly over the same path, which produces local erosion or tracking paths.

Since the barrier has to overhang the insulator shed around the periphery of the shed, it has to be located so as to remain substantially concentric on the insulator. If the insulator is subjected to washing by water jets, the location of a barrier must be sufficiently firm to prevent it from being moved bodily or distorted during washing. For this reason, it is preferred to secure the barrier onto the surface of the shed. This may be done by means of an adhesive securing the aforementioned projections to the shed or, preferably, by locating the barrier by shaping the inner periphery of the barrier so that this inner periphery comes into contact with the stem at a number of points around the periphery although leaving gaps between these contact regions to provide a path for a discharge to enter around the inner periphery of the barrier into the region between the barrier and the upper surface of the shed. This gap around the central portion or stem of the insulator is not critical in dimensions but typically might be made ten or more millimeters wide in the radial direction. Thus the inner periphery of the barrier may be formed as a series of inwardly directed projecting tongues which have only a small space between them and the central portion or stem, the tongues being narrow in width compared with the gaps between them. The number of tongues is not critical but has to be such as to locate the barrier concentrically with sufficient accuracy to maintain the required overhang at the periphery of the shed. Typically some four to twelve inwardly-directed tongues might be provided.

To prevent the barrier from lifting, for example, when the insulator is being washed with water jets, it may be desirable to shape the barrier so that it is positively engaged around its inner periphery. One convenient form of construction, suitable for many types of multi-shed insulators, is to form the aforementioned inwardly-directed tongues of such length that they extend upwardly adjacent the stem or body of the insulator to locate under the next shed of the insulator. This arrangement is very convenient when the barrier is flexible. More generally however a spacer may be put around the insulator stem or body, the spacer being shaped, e.g. having a groove, to engage and locate the inner periphery of the barrier.

Instead of having projections formed on the under surface of the barrier to space it from the shed surface, in some cases it may be preferable to use a barrier with a smooth under surface spaced from the upper surface of the shed by other means. For example, the upper surface of the shed may itself be provided with projections, or one or more spacing elements may be provided between the barrier and the shed. Such a spacing element, for example a spider made of the same material as the barrier or a different material, may conveniently be formed integrally with the aforementioned spacer around the stem of the insulator if such a spacer is used.

When the barriers are made of flexible material they are preferably formed from a single sheet of material divided radially from its inner to its outer periphery, which sheet can then be put around the insulator and joined where it was radially divided. Insulator sheds are commonly of generally conical form, although often rounded. By removing a sector from a circular sheet, the radial edges of the sheet may be joined to form a cone. By using sheets moulded to shape, it is possible to ensure conformity with any given shed profiles. Jointing of the two edges of the sheet after putting it around the insulator stem can readily be effected in a number of ways. The two portions of the sheet might be secured by an adhesive, preferably being overlapped. They may be secured by fasteners of dielectric material, for example nuts and bolts or rivets or by simple peg and hole push fit fasteners. In another arrangement the portions of the sheets to be joined are made to overlap and are shaped so that they resiliently interlock with one another or are secured together by elements engaging in slots or grooves in the overlapping portions. It is possible to secure the two portions to be joined with their edges abutting, e.g. by joining each portion separately to a jointing element. A suitable dielectric filler material may be put between jointed parts. Overlapping portions might be spaced apart, in which case the amount of overlap should exceed the spacing. If they are close together, it is preferable to put a filler material between them to prevent the ingress of moisture. Although it is convenient to use a single sheet with the edges joined together, obviously two or more sheet portions may be jointed to form a single barrier; such a technique may be useful when the barrier is rigid e.g. in the case of a barrier formed from moulded sections, of an acrylic resin such as polymethylmethacrylate.

By jointing a sheet or sheets as described above, it it readily possible to make the barrier removable from an insulator either by disconnecting the fastenings and breaking the seal, or simply by cutting the barrier with a knife. It thus becomes possible to remove and replace such barriers if they deteriorate in service. More particularly however, it enables these barriers to be put on existing insulators to improve their performance.

Preferably, these barriers are formed of a material having as far as possible good weathering capability, resistance to roughening and to discharge deterioration and capable of use as a normal insulating surface in pollution. It is desirable also that the material should be such that permanent tracks will not form in the path of discharges. Physical toughness to resist the mechanical forces and impacts on the porcelain substrate resulting from wind, high pressure, washing etc. is desirable. Many materials may be used, particularly bearing in mind the possibility of ready replacement in the event of deterioration of the material. However particularly suitable materials are silicone rubber formulations containing anti-weathering and anti-track additives and elastomers based on other polymers, such as polyolefins and butyl polymers, containing fillers to improve the weathering and discharge resistance. Suitable materials, including anti-tracking additives are described, for example, in British Pat. Nos. 831,490; 837,673; 1,037,930; 1,059,550 and, especially, in British Pat. Nos. 1,303,432; 1,337,951 and 1,337,952.

The surface of the shed underneath the barrier may be coated with a material having adequate track-resistant properites, e.g. a cold-cure silicone rubber The whole insulator may conveniently be coated with such a material, e.g. by spraying with a spray gun. Some insulator materials, e.g. porcelain or glass are particularly susceptible to damage by an arc discharge over the surface and such a coating provides a protective layer reducing the possibility of deleterious effects of discharges on the insulator surface. Such discharges may cause some ablation of the coating layer but, with the constructions described above, it is readily possible to remove the barrier or barriers and re-spray the insulator so as to make good any damage to the coating.

When it is desired to improve the performance of a given shape of insulator by the incorporation of barriers in accordance with the present invention, such barriers may in some cases conveniently be incorporated initially, during the construction of the insulator. For example, in the case of an insulator which is assembled from a glass fibre rod surrounded by a flexible polymeric housing including a number of sheds, the barriers may be formed integrally with, or fitted to, the sheds prior to final assembly of the insulator.

Thus, in addition to providing a barrier as described above the present invention also provides a polymeric shed provided with an integral or fitted barrier.

BRIEF DESCRIPTION OF THE DRAWINGS

FIG. 12 is a cross sectional elevation taken along line 12—12 of FIG. 11;

FIGS. 14 and 15 illustrate one embodiment which is shown in cross section in FIG. 14 taken along line 14—14 of FIG. 15.

Referring to FIG. 1, the barrier comprises a sheet 10 of flexible material, e.g. a silicone rubber formulation containing anti-weathering and anti-track additives or an elastomer based on polyolefins or butyl polymers containing fillers to improve the weathering and discharge resistance. The sheet is of uniform thickness, typically a few millimeters thick. As seen in the drawing, it is of generally annular form although extending around only part of a complete circle so that, when the ends 11 are joined together, the sheet will form a cone. The outer edge 12 is a circular arc. As shown, the inner edge 13 has six inwardly-extending projections or tongues. In FIG. 1, there are also shown (broken lines) three different inner peripheries provided with six, seven and eight tongues for use on insulators with different size stems. Formed integrally with the sheet are downwardly-extending projections 15, a few millimeters high; these projections 15 which are shown in elevation in FIG. 3, are of uniform length so that the sheet 10 will sit on the upper surface of the shed of the insulator and be substantially uniformly spaced thereon. For joining the two ends of the element together, one end is formed with a number of pegs 16 (as shown in FIG. 2) which are dimensioned also to serve as spacing elements for spacing the sheet from the surface of the shed, these pegs being a tight press fit in holes 17 in the other end of the element. When the barrier sheet 10 is put on an insulator, the pegs 16 can be pressed into the holes 17, using if necessary simple compression tongs. A room temperature setting insulating filler is put in the joint where the two parts of the sheet overlap so as to exclude all moisture from this joint. The inwardly projecting tongues can be cut to size to accommodate different core diameters.

FIG. 4 illustrates diagrammatically a discharge barrier in position over a shed of an insulator. The inwardly-directed tongues 14 extend inwardly to locate the barrier with respect to the stem 20 of the insulator. The barrier sheet 10 sits on the upper surface of a shed 21, the aforementioned projections 15 spacing the barrier sheet away from the upper surface of this shed. As seen at 22, the outer periphery of the barrier overhangs beyond the outer edge of the shed. Before putting the discharge barrier in position on the insulator, the insulator may be coated with a thin layer of a track-resistant material such as cold-cure silicone rubber; this conveniently is done by spraying. The coating is to protect the surface of the insulator lying immediately underneath the barrier sheet although, in practice, the whole insulator may be coated during the spraying process. This coating gives a protective layer reducing the possibility of damage to the insulator surface by discharges.

Figure 4:
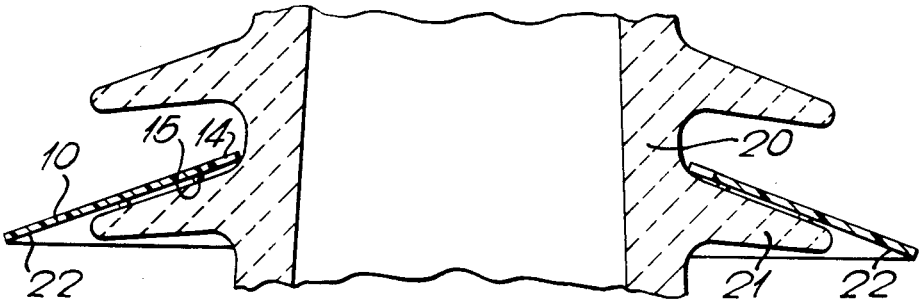
FIG. 4 illustrates diagrammatically a discharge barrier in position on a shed of an insulator.

The insulator shown in FIG. 4 is a high voltage barrell insulator and, with this particular embodiment, the discharge barrier may be held against lifting by the use of an adhesive securing the spacing projections 15 to the upper surface of shed 21. Other ways of holding down the discharge barrier will be apparent however from the following description of other insulators.

Figure 5:
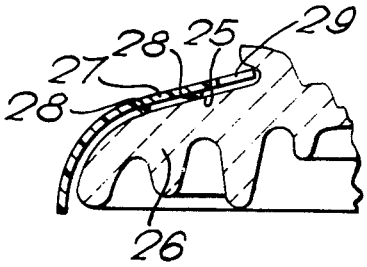
FIG. 5 is a side elevation partly in section of an insulator with a domed shed and having a discharge barrier thereon.

As shown in FIG. 5, an insulator with a domed surface 25 on a shed 26 may be provided with a discharge barrier 27 shaped to conform to the upper surface of the shed so as thereby to give a substantially uniform gap between the discharge barrier and the shed. The spacing between the discharge barrier and shed may be determined as before by projections 28 formed on the barrier 27 for example by integral moulding or by friction moulding. A tongue 29 is provided to space the barrier from the stem of the insulator. Such a dome shaped discharge barrier may be formed of flexible material as previously described or may be formed of two or more mouldings of rigid material.

Figure 1:
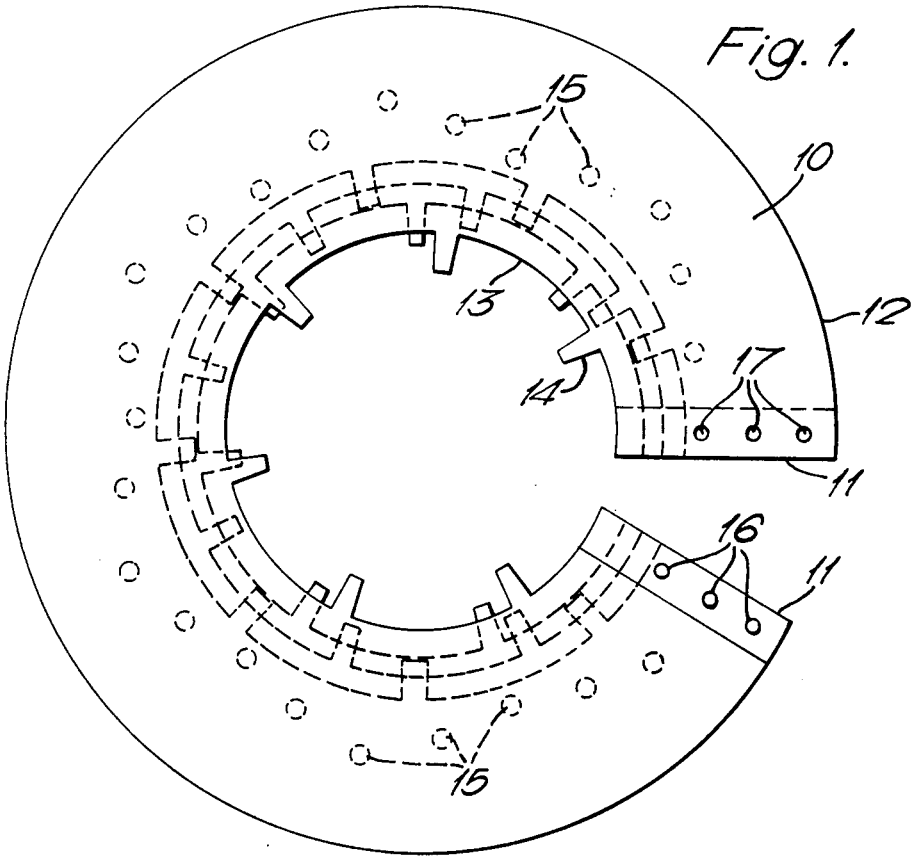
FIG. 1 is a plan view of a discharge barrier before fitting around an insulator, this view showing four alternative inner peripheries for fitting on different size insulator stems.
Figure 2:
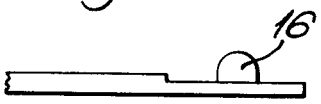
FIG. 2 is an elevation showing a fixing projection on a discharge barrier.
Figure 3:
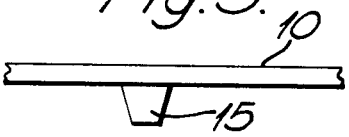
FIG. 3 is an elevation of a spacing projection on a discharge barrier.
Figure 6:
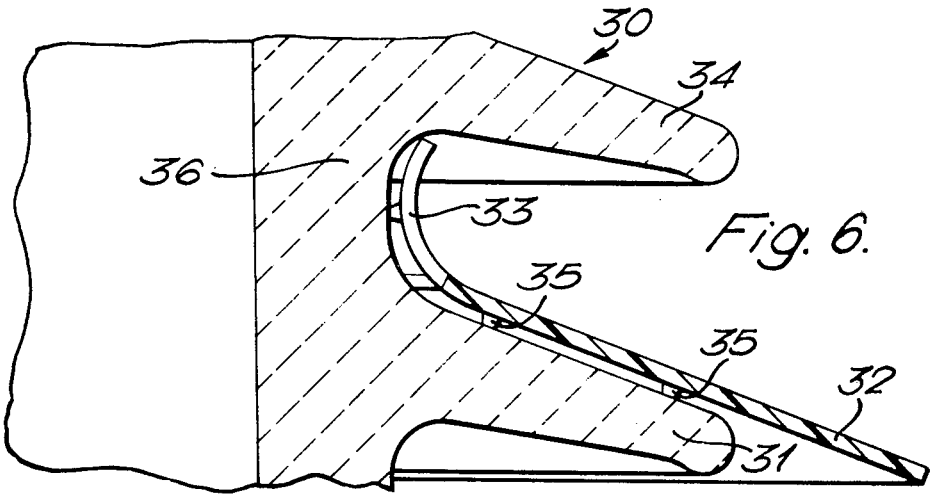
FIG. 6 is a partial sectional elevation of a plainshedded barrel insulator with a discharge barrier thereon.

FIG. 6 shows part of a plain-shedded barrel insulator 30 having a shed 31 with a barrier sheet 32 secured above this shed 31. The sheet 32 is of the form shown in FIG. 1. The inwardly-extending tongues, one of which is shown at 33, in this embodiment are bent upwardly so that their inner tips lie in contact with the under surface of a shed 34 which is the next shed above the shed 31 on the insulator body to prevent the sheet from rising. The sheet is spaced away from the surface of the shed 31 and stem 36 of the insulator by integral spacers 35 and hence it is firmly located on the insulator.

Figure 7:
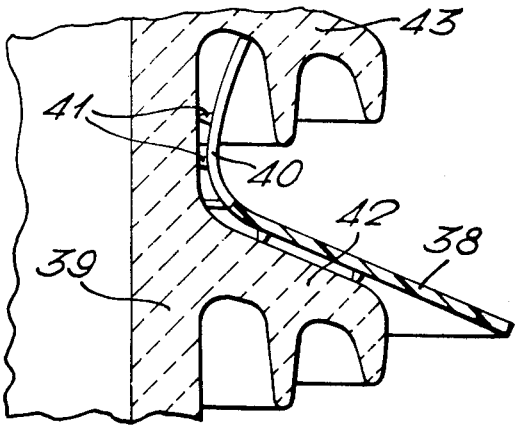
FIG. 7 is a view similar to FIG. 6 of an antifogshedded insulator with a discharge barrier.

FIG. 7 shows a barrier sheet 38 on an insulator 39 which, in this case is an antifog-shedded barrel insulator. In this particular construction the barrier sheet 38 has tongues 40 and has integral spacers 41 on the sheet and tongues to space the conical portion of the sheet above a shed 42 and the tongues away from the insulator stem. The inner tips of the tongues 40 extend upwardly and are located on the under surface of a next adjacent shed 43.

Figure 8:
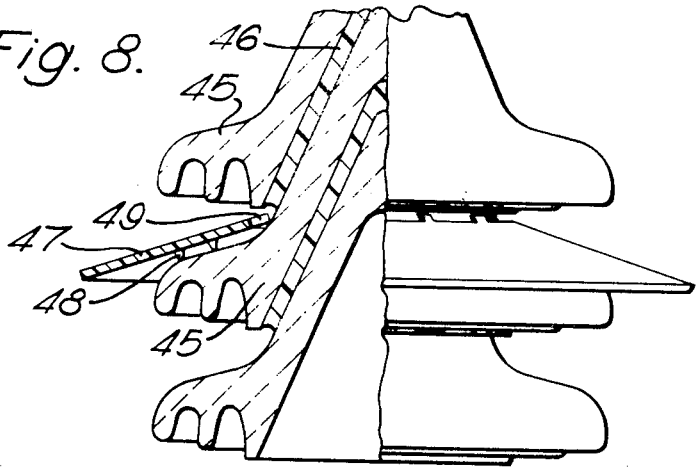
FIG. 8 is a side elevation, partly in section, of a multiple cone post insulator with a discharge barrier.

FIG. 8 is a vertical elevation, partly in axial section, of part of a multiple cone post insulator having porcelain elements 45 of generally conical form nesting one in another and secured together by a cement 46. A barrier sheet 47 has integral spacers 48 to locate it above the upper surface of one of the porcelain cones 45. In this construction, the sheet 47 has inwardly-directed tongues 49 which locate between the conical porcelain members 46 without having to be bent up.

Figure 9:
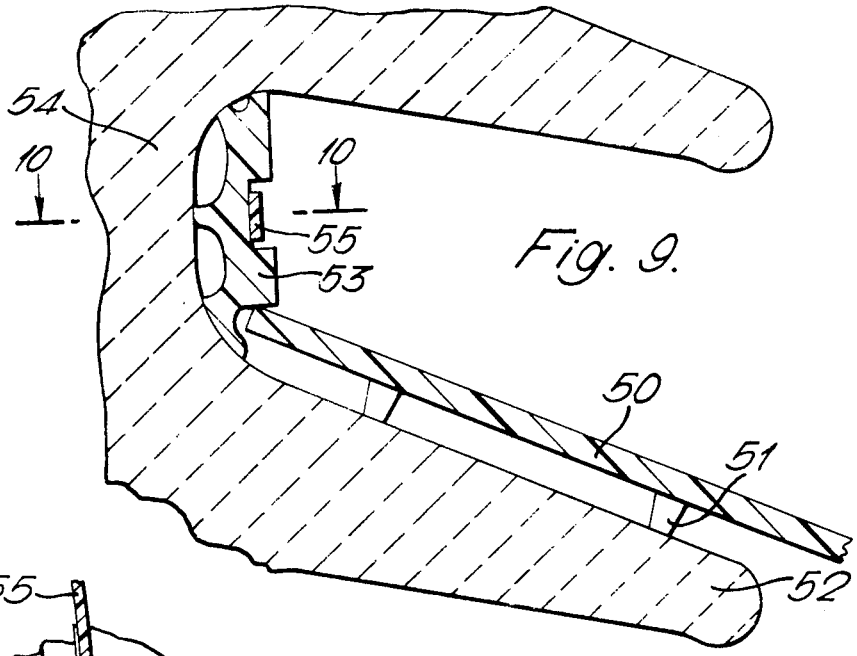
FIG. 9 is a sectional elevation of part of an insulator having a discharge barrier and spacer from the stem.
Figure 10:
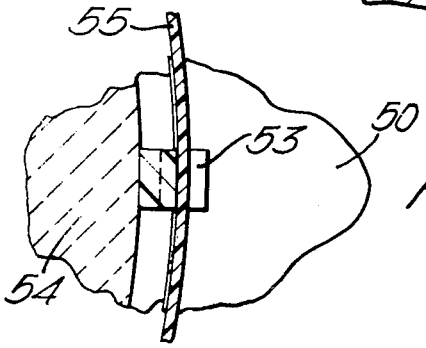
FIG. 10 is a fragmentary sectional view along the line 10—10 of FIG. 9.

FIGS. 9 and 10 show a barrier sheet 50 with integral spacers 51 on top of a shed 52 of an insulator. In this particular embodiment, the sheet 50 does not have any inwardly-directed tongues but its inner edge engages under spacers 53 formed of dielectric material. A number, for example, twelve, such spacers are arranged spaced around the insulater stem 54 and secured in position by a strap 55. The strap 55 is made of a flexible plastic material and has, at one end, a sawtooth serrated edge which can be pulled through a suitably shaped hole in the other end of the strap so that the strap can be clamped tight and would not loosen.

Figure 11:
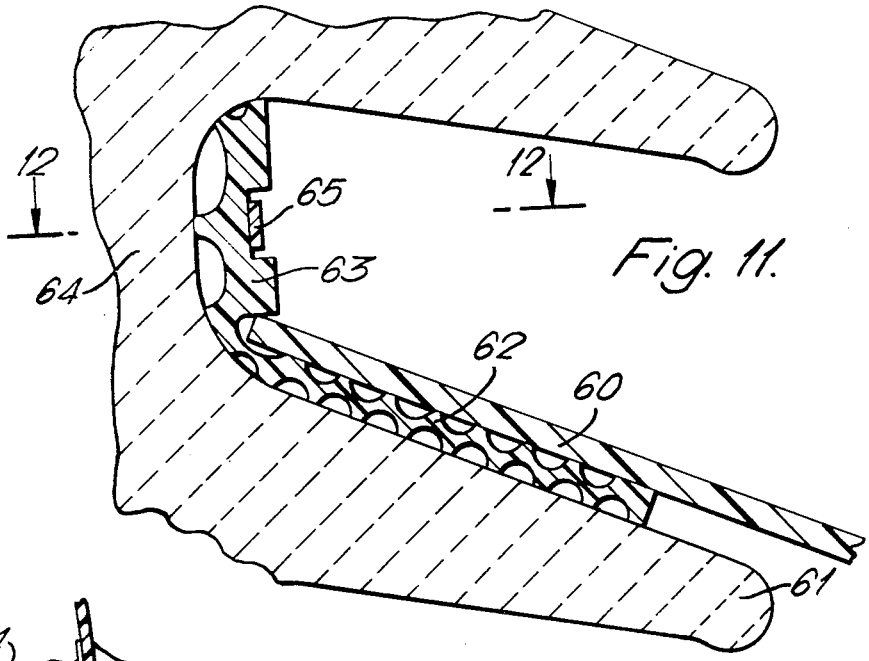
FIGS. 11 and 12 are views similar to FIGS. 9 and 10 respectively but showing a modified construction.
Figure 12:
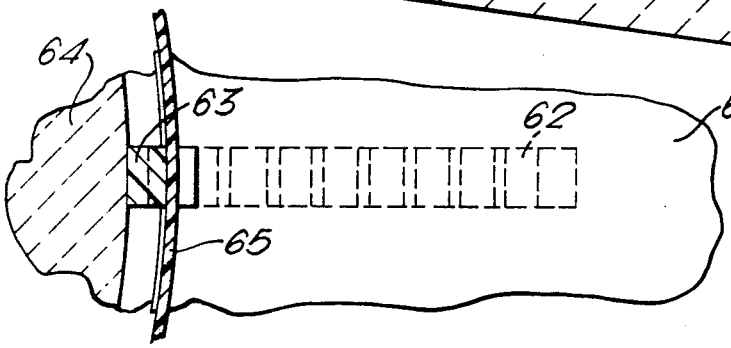

FIGS. 11 and 12 show a modification of the arrangement of FIGS. 9 and 10. In FIGS. 11 and 12 the barrier sheet 60 has a flat under surface and is spaced away from a shed 61 by a spider 62 which is formed integrally with a spacer 63. As before a number of such spacers, for example twelve, might be put in position around the insulator stem 64 and held in place by a strap 65. The spider portion of the spacer comprises, in this particular embodiment, an arm of uniform width extending part of the way across the top of the shed and having ribs on its upper and lower surfaces to engage respectively the undersurface of the sheet 60 and the top surface of the shed 61.

In all the embodiments thus far described, only one barrier sheet has been mentioned. It will be understood however that usually a number of such barrier sheets would be put on each insulator.

Figure 13:
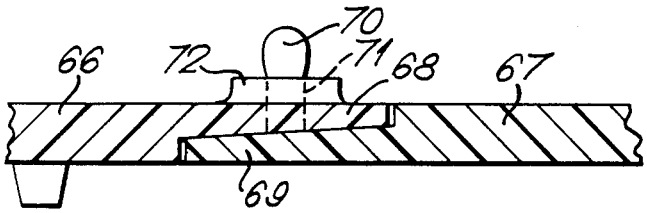
FIGS. 13 to 16 illustrate the jointing of marginal portions of a sheet.

FIG. 13 shows in further detail on construction of joint for joining the marginal portions of a barrier sheet. In the construction shown in FIG. 13 the two portions of the sheet to be joined are shown at 66 and 67 and, at their marginal edges, they are reduced in thickness to form overlapping portions as shown at 68 and 69, the portion 69 having a plurality of upstanding projections 70 which pass through holes 71 in the portion 68. Around each hole 71, the portion 68 has a thickened part to form a boss 72 for strengthening purposes. A cold-cure silicone elastomer is provided between the two points to be joined to prevent any ingress of moisture.

It will be appreciated that, although FIG. 13 shows one particular construction, there are many variants possible. Pegs for example might be provided through both halves of the joint with a filler around the pegs or a half lap or scarf joint might be glued or the overlapping arrangement shown in FIG. 13 might be glued.

Figure 14:
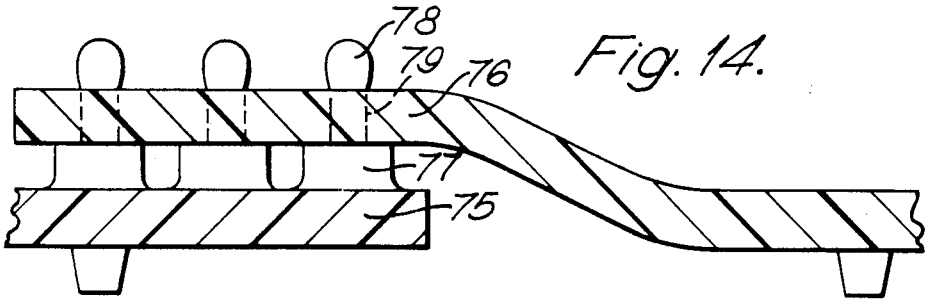
Figure 15:
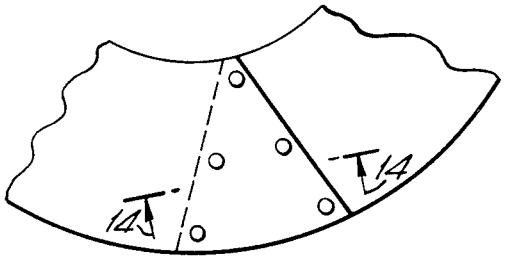
Figure 16:
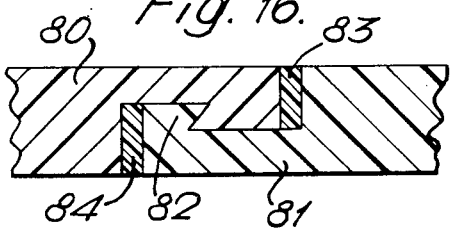

FIGS. 14 and 15 illustrate another construction for joining together two marginal portions of a sheet. In FIG. 14, the two portions 75, 76 are overlapped but are spaced apart by means of bosses 77 moulded integrally with pegs 78 on the portion 75. These pegs fit through holes 79 in the portion 76 as a press fit, securing the two parts together. FIG. 16 illustrates a construction in which two portions 80, 81 are interlocked, a semi-dovetail 82 being formed on the portion 81 to fit in a correspondingly shaped groove in the portion 80, the two parts being locked together by a filler as shown at 83 and 84.

Figure 17:
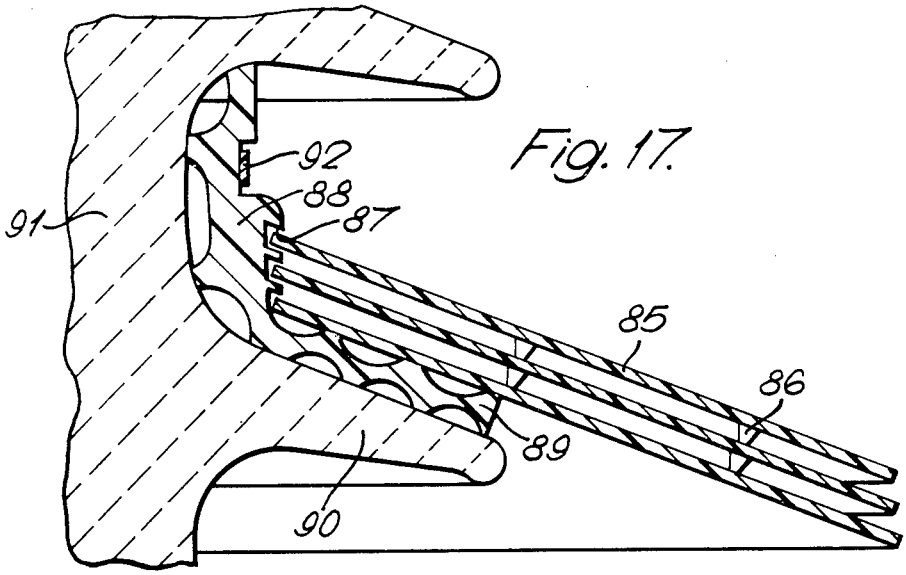
FIGS. 17 to 19 illustrate discharge barriers having a sheet formed as a helix.
Figure 18:
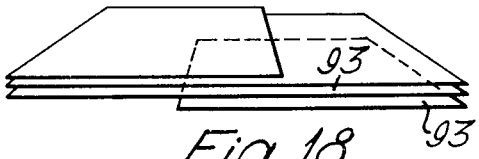
Figure 19:
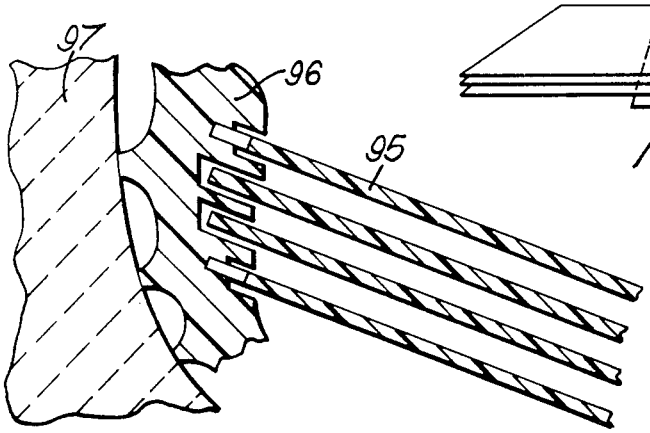

As previously mentioned, it is possible to arrange the barrier sheet so that it extends around the insulator for several complete turns of a helix. Such arrangements are illustrated in FIGS. 17, 18 and 19. Referring to FIG. 17 there is shown a sheet 85 formed as three turns of a helix and having integral spacers 86 for keeping the turns spaced apart. In the construction shown in FIG. 17 the inner ends of the three turns of the helix are located in grooves 87 in spacer members 88 which are formed integrally with a spider arm 89 serving to keep the lowest turn of the helix spaced away from the upper surface of a shed 90 of the insulator. A number of spacer members 88 are secured in position by a strap 92 around the stem 91 of the insulator.

As shown in FIG. 18, which is a view in side elevation of a helically wound sheet, instead of keeping the turns of the helix apart so that they form separate air gap paths for the discharge, the turns may be put close together as shown in FIG. 18 where the turns 93 form in effect a thick barrier sheet. Such a construction enables relatively thin and hence flexible material to be employed yet the resultant sheet is effectively a thick sheet.

FIG. 19 shown a modification of the construction of FIG. 17 in which the inner peripheries of the various turns of the sheet 95 forming the helix are provided with notches so as to straddle each of a number of spacers 96. The helical sheet 95 thus serves to hold and locate the spacers around the stem 97 of an insulator.

In any of the above-described embodiments, the sheet can be made stiffer by forming it with radial ribs and/or with a rib around its outer periphery.

We claim:

1. A method of improving an insulator having a central portion or stem and one or more sheds comprising the step of putting a barrier of dielectric material over the upper surface of a shed but spaced away therefrom, the barrier extending radially outwardly to overhang the periphery of the shed by at least 5 mm around the whole of the shed, the barrier furthermore being spaced radially from the central portion or stem of the insulator over at least a substantial part of the inner periphery of the barrier.

2. A method as claimed in claim 1, wherein the spacing from the central portion or stem is 2 to 20 mm.

3. A method as claimed in claim 1, wherein at least the upper surface of the shed over which the barrier is put is coated with a track-resistant material.

4. An insulator having a central portion or stem and one or more sheds extending outwardly therefrom in combination with a discharge barrier comprising a sheet of dielectric material and positioned around the central portion or stem of the insulator above at least one shed, said sheet being spaced away from the upper surface of the shed, said sheet furthermore being arranged to overhang the shed by extending radially outwardly therefrom for a distance of at least 5 mm, said sheet furthermore being dimensioned to leave a gap between the insulator central portion or stem and the sheet over at least a substantial part of the inner periphery of the sheet.

5. The combination as claimed in claim 4, wherein said sheet extends radially outwardly to overhang the shed by a distance of at least 20 mm.

6. The combination as claimed in claim 4, wherein said gap between the barrier and the central portion or stem is 2 to 20 mm.

7. The combination as claimed in claim 4, wherein the spacing of the barrier from the upper surface of the shed is substantially uniform.

8. The combination as claimed in claim 4, wherein a number of small projections are provided on the undersurface of the barrier sheet.

9. The combination as claimed in claim 8, wherein the projections are arranged on the sheet to be located uniformly around the axis of the insulator.

10. The combination as claimed in claim 8, wherein adjacent projections are staggered to be at different radii from the centre of the insulator.

11. The combination as claimed in claim 10, wherein the sheet is secured to the surface of the shed by an adhesive on said projections.

12. The combination as claimed in claim 4, wherein the upper surface of the barrier sheet is smooth.

13. The combination as claimed in claim 4, wherein the inner periphery of the barrier is shaped so that this inner periphery comes into contact with the stem of the insulator at a number of points around the periphery although leaving gaps between these contact regions.

14. The combination as claimed in claim 13, wherein the inner periphery of the barrier is formed as a series of inwardly-directed projecting tongues, the tongues being narrow in width compared with the gaps between them.

15. The combination as claimed in claim 14, wherein the barrier has four to twelve inwardly-directed tongues.

16. The combination as claimed in claim 14, wherein said inwardly-extending tongues extend upwardly adjacent the stem or body of the insulator to locate under the next shed.

17. The combination as claimed in claim 14, wherein a spacer is provided around the insulator stem or body, the spacer being shaped to engage and locate said inwardly-directed tongues.

18. The combination as claimed in claim 4 and having a spacer around the insulator stem or body engaging the inner periphery of said barrier at a plurality of points around that periphery so that a gap is left between the inner periphery of the barrier and the spacer or insulator body or stem over at least a substantial portion of the inner periphery.

19. The combination as claimed in claim 4, wherein at least one spacing element is provided to space the lower surface of the sheet from the upper surface of the shed.

20. The combination as claimed in claim 19, wherein the spacing element is integral with a spacer provided around the insulator stem or body.

21. The combination as claimed in claim 4, wherein the upper surface of the shed is provided with a number of small projections.

22. The combination as claimed in claim 4, wherein the barrier is sufficiently flexible that it can be put around an existing insulator of porcelain or glass or other conventional material.

23. The combination as claimed in claim 22, wherein the discharge barrier is formed of a single sheet of material divided radially from its inner to its outer periphery, so that the sheet can be put around the insulator and joined where it was radially divided.

24. The combination as claimed in claim 23, wherein the two edges of the sheet, after being put around the insulator, are secured together with an adhesive.

25. The combination as claimed in claim 23, wherein the two edges of the sheet, after being put around the insulator, overlap and are secured together by fasteners of dielectric material.

26. The combination as claimed in claim 25, wherein said fasteners are nuts and bolts or rivets.

27. The combination as claimed in claim 25, wherein said fasteners are peg and hole push fit fasteners.

28. The combination as claimed in claim 23, wherein the two portions of the sheet to be joined are secured with their edges abutting, but joining each portion separately to a jointing element.

29. The combination as claimed in claim 23, wherein the portions of the sheet to be joined overlap and are shaped resiliently to interlock with one another.

30. The combination as claimed in claim 23, wherein the portions of the sheet to be joined overlap and are secured together by elements engaging in slots or grooves in the overlapping portions.

31. The combination as claimed in claim 23, wherein a dielectric filler material is put between the jointed parts.

32. The combination as claimed in claim 22, wherein said sheet is shaped so that it can be put around the insulator body or stem as a helix having two or more turns.

33. The combination as claimed in claim 32, wherein adjacent turns of the helix are secured in contact.

34. The combination as claimed in claim 32, wherein adjacent turns of the helix are spaced apart.

35. The combination as claimed in claim 22, wherein said sheet has radial stiffening ribs.

36. The combination as claimed in claim 22, wherein said sheet has a peripheral stiffening rib.

37. The insulator of claim 4 wherein said shed or sheds is made from a flexible polymeric material and said barrier is formed integrally therewith.

38. The insulator of claim 4 wherein said shed or sheds is made from a flexible polymeric material and said barrier is fitted thereto.

39. A shed for an electrical insulator, comprising a flexible polymeric shed and a barrier of dielectric material, said barrier being spaced away from the upper surface of said flexible polymeric shed and having an inner periphery of greater diameter than the inner periphery of said flexible polymeric shed.

40. The shed of claim 39 wherein said barrier of dielectric material is integral with said flexible polymeric shed.

41. An annular barrier for fitting on a shed and about a stem of an electrical insulator, comprising an annular barrier sheet of flexible, dielectric, anti-tracking material, said annular barrier sheet having a substantially radial division, means for joining said barrier sheet to close said substantially radial division and a plurality of projections on one side of said annular barrier sheet to space said annular barrier sheet from the upper surface of the shed.

* * * * *